US006209760B1

(12) United States Patent
Fuchs

(10) Patent No.: US 6,209,760 B1
(45) Date of Patent: Apr. 3, 2001

(54) MEDIA DISPENSER

(75) Inventor: Karl-Heinz Fuchs, Radolfzell (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 0 days.

(21) Appl. No.: 09/255,098

(22) Filed: Feb. 22, 1999

(30) Foreign Application Priority Data

Feb. 25, 1998 (DE) ..... 198 07 922

(51) Int. Cl.[7] ..... B65D 88/54
(52) U.S. Cl. ..... 222/321.6; 222/207
(58) Field of Search ..... 222/321.6, 207

(56) References Cited

U.S. PATENT DOCUMENTS

| | | | | |
|---|---|---|---|---|
| 2,128,567 | | 8/1938 | Wilson et al. | 221/147 |
| 4,830,284 | * | 5/1989 | Maerte | 222/321 |
| 5,115,980 | | 5/1992 | Skorka | 222/321 |
| 5,277,559 | | 1/1994 | Schultz | 417/543 |
| 5,979,711 | | 11/1999 | Fuchs et al. | 222/321.2 |

FOREIGN PATENT DOCUMENTS

| | | |
|---|---|---|
| 34 20 961 A1 | 12/1984 | (DE) . |
| 34 45 562 A1 | 6/1986 | (DE) . |
| 40 35 663 A1 | 5/1992 | (DE) . |
| 43 32 869 A1 | 4/1995 | (DE) . |
| 197 12 256 A1 | 11/1997 | (DE) . |
| 297 17 240 U1 | 1/1998 | (DE) . |
| 0 340 724 A2 | 5/1989 | (EP) . |
| 0 370 257 | 10/1989 | (EP) . |
| 26 40 695 | 12/1998 | (FR) . |
| 10-059403 | 3/1998 | (JP) . |
| WO 96/40332 | 6/1996 | (WO) . |

* cited by examiner

*Primary Examiner*—Kevin Shaver
*Assistant Examiner*—David Deal
(74) *Attorney, Agent, or Firm*—Quarles & Brady LLP

(57) ABSTRACT

A dispenser (1) includes a traveling member (50) extending integrally from the pump piston (17) up to the nozzle body (49) of the medium outlet (20). The traveling member (50) is enveloped by a separate runner body (60) which has handles (62). A core body (30) is located within runner body (60) and extends over the entire length of the dispenser (1). The base body (4) to be secured to the reservoir (29) is composed from two interconnected components (8,9) which commonly bound a free space (80) for stress reliefing the piston lip (17) in the operational end position.

25 Claims, 2 Drawing Sheets

MEDIA DISPENSER

TECHNICAL FIELD AND BACKGROUND OF THE INVENTION

The invention relates to a dispenser in which media of all possible aggregations may be stored in a tightly sealed condition or discharged. The dispenser is intended to be clasped, freely carried and/or actuated single-handedly. The medium may be liquid, pasty, powdered, gaseous and/or granular. It is precisely metered when discharged. The dispenser is composed mostly or completely of injection-molded or plastics parts. All internal surfaces coming into contact with the medium are made from polymeric material The medium is atomized or, where necessary, discharged in larger droplets.

OBJECTS OF THE INVENTION

One object of the invention is to provide a dispenser which avoids the disadvantages of prior art configurations or contributes to the advantages cited below. A further object is to make the dispenser sealingly tight against leakage. Still a further object is to achieve reliable dispenser function or a simple construction. A still further object is to contribute to and facilitate assembly of the dispenser. A further object is to avoid contamination of the stored medium with soil or germs. A still further object is to contribute to fastening of the dispenser to a reservoir without damage, in particular to sensitive resilient members, like piston lips.

SUMMARY OF THE INVENTION

According to the invention, the dispenser comprises a dispensing wall penetrated by a medium duct. The dispensing wall is substantially integral with two portions of a traveling member spaced from each other or from the wall. The traveling member includes a medium impeller such as a plunger, a base body closure such as a slidable cylinder cover, a valve body element, and a base body blocking member. Each traveling member includes a sliding or stopping face, particularly an inner or outer circumferential face, an edge face and/or an end face. This face can also be a single annular edge of a plunger lip sliding by this edge only.

The traveling member that is penetrated by the medium duct mounts between its ends or is spaced away from a runner body extending at least up to its external face or projecting therefrom. This body is axially and/or radially firmly connected to the runner and forms actuating handles. Such a body may also support a plunger lip against receiving excessive movements when this plunger lip is less thick than the remaining portions of the body carrying it.

The compression or pump chamber is bounded on the inner circumference by two separate components. One component forms the sole sealing face for one or two plunger lips. The other component forms a medium inlet body. Both parts together form two concentric, nested, annular end faces for common support on the end face of the bottleneck.

Also, means are provided to positively limit an operating position like the actuated end position by stops and to then hold the plunger lip free of axial and/or radial compressive forces. Thereby, the dispenser, when in the actuated end position, can be axially and forcibly brought into firm engagement with the reservoir or some other base support without the plunger lip being damaged by such compressive forces. Between the stop faces of the dispenser a separate stop member may also be provided which after assembly does not remain on the dispenser.

In including the features, such as configurations, effects etc. in the present invention, reference is made to U.S. Pat. No. 5,938,084, issued Aug. 17, 1999; U.S. Pat. No. 5,927,559, issued Jul. 27, 1999; U.S. Pat. No. 5,884,819, issued Mar. 23, 1999 and U.S. Pat. No. 6,059,150, issued May 9, 2000. The invention is also suitable for dispensers having a reservoir which is intended for a once-only use or for being emptied in a single operating stroke. Such dispensers may be provided for operation through a unidirectional, individual and interrupted or uninterrupted stroke. Thereby, the medium reservoir is a pressure chamber provided in a vessel, and the vessel has a cap with one or more traveling members.

BRIEF DESCRIPTION OF THE DRAWINGS

Example embodiments of the invention are explained in more detail in the following and illustrated in the drawings in which.

DESCRIPTION OF THE PREFERRED EMBODIMENTS

Figure 1:
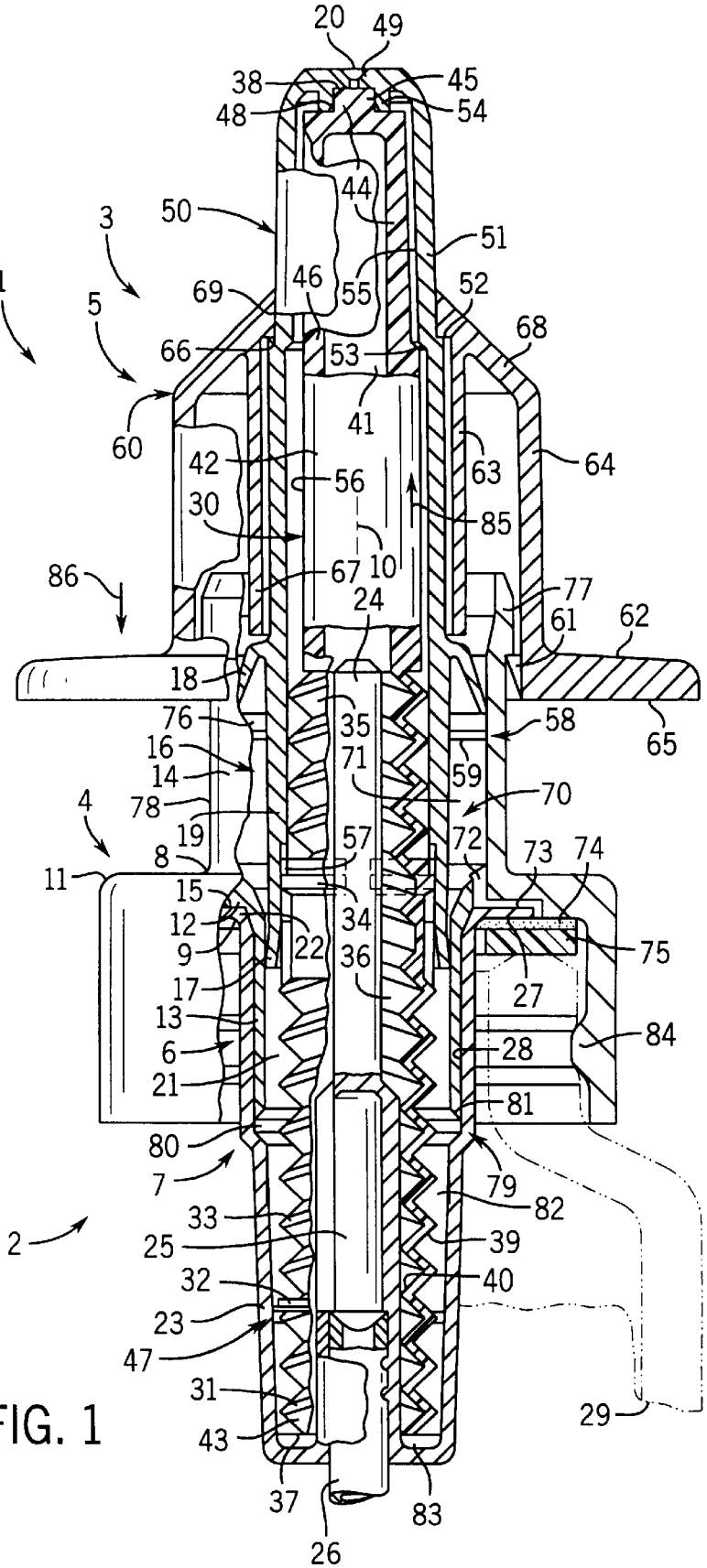
FIG. 1 is a partly axial loss-section of a dispenser according to the invention and when in a rest or initial position.

The dispenser 1 includes units 2, 3 axially movable against each other by a manual discharge actuating unit 5. Base unit 2 includes base body 4 with a housing 7 of thrust piston pump 6, a support body 8 and a pressure body 9 commonly forming housing 7 and located in the center dispenser axis 10. The main flow direction 85 is parallel to axis 10 and directed from unit 2 through unit 3 outwardly. The direction 86 of the actuating motion of unit 3 is oriented opposite to direction 85. The return motion in direction 85 ends in the rest position.

Body 8 has a cap which forms a support flange 11. The end wall 12 is supported on its inside by both body 9 and a further annular face 22. Only beyond the inside of end wall 12 and at the adjoining inner circumference thereof a shell-shaped cylindrical side wall 13 protrudes into body 9. An upwardly extending cylindrical member 14 protrudes radially outside of the outer circumference of wall 13 beyond wall 12 only in direction 85 while being a shell-shaped upwardly extending end wall. Wall 14 juts into unit 3 and surrounds it commonly with its continuation wall 13 as a shield. The inside of wall 12 has a recessed reception 15 for engaging the upstream end of body 9 centered without radial clearance and axially abutted.

Unit 3 has a piston unit 16 including piston 17 of pump 6, a piston or base body closure 18 for the downstream end of body 4 and a piston shaft 19 directly carrying annular and spaced plungers 17, 18. The medium is conveyed by pressure through the interior of plungers 17, 18 in direction 85 to medium outlet 20 of unit 3 from which the medium emerges into the open while exiting from dispenser 1.

The coaxially nested shells 13, 23 of stepped bodies 8, 9 bound a pressure or pump chamber 21 which is reduced on actuation and reaches valveless almost up to the downstream end of unit 3 or to outlet 20. The upper end of body 9 forms a flange 22 or annular disk protruding beyond the outer circumference thereof. Flange 22 is fully countersunk and radially centered in reception 15. Only the shell of body 9 forms an appendage 23 protruding beyond the open end of cap 11 in direction 86. Body 8 has no parts protruding beyond this cap end.

Body 9 has a pin projection 24 freely protruding from its upstream end in direction 85 into parts 11, 13, 14, 17, 18, 19. Pin 24 forms that portion of body 9 which protrudes furthest in direction 85 and beyond flange 22. A riser tube 26 juts from this end of body 9 in direction 86 up to the bottom of a bottle-shaped reservoir or base support 29. Tube 26 connects downstream to an inlet duct 25 traversing body 9. Tube 26 is inserted into the end of body 9 in direction 85. Duct 25 traverses pin 24 only over part of its length. Duct 25 emerges at the outer circumference of pin 24 with a slot so that the slimmer end section of spigot 24 has full cross-sections. Section 22 forms with an upstream end face and in the plane of the support face of wall 12 a radially inner support member 27 for direct support relative to reservoir 29. The outer circumference of shell 13 adjoins the inner circumference of shell 23 coaxially over the full length of shell 13 so that pressure space 21 is sealed at this point.

A core body 70 is inserted in both units 3, 4 and is an oblong, one-part component. Body 30 extends from the upstream outermost wall of body 9 down to the downstream outermost wall of unit 3 which outlet 20 traverses. The upstream end forms a bellows-type valve spring 31 and in turn directly interconnected in direction 85 an annular disk-shaped valve element 32, a bellows type return spring 33, a sleeve-shaped actuating member 34, and a bellows type valve spring 35 followed by a dimensionally rigid section 46 extending up to the core end. By its inner circumference the length-variable body 30 bounds a suction chamber 36 permanently valveless connecting to duct 25 and reservoir 29. When shortened chamber 26 also serves as a compression chamber for returning the medium into reservoir 29. The upstream end face of body 30, 31 forms an annular transition edge 37, along which the medium flows while changing direction out of chamber 36 into an annular chamber or antechamber at the outer circumference of bellows 31. This antechamber directly connects to chamber 21 at valve member 32. Annular chamber 36 is also bounded by pin 24 and extends almost down to the downstream end of body 30. At this end body 30 forms a stop 38 liftable from unit 3 in direction 86.

Longitudinal sections 31, 33, 35 connect to each other and forms at the outer circumference a helically pitched guiding face 39 while forming at the inner circumference a correspondingly helical guiding face 40 extending over the full length of sections 31 to 35. The outer circumference of section 35 forms a radially and axially elastically pliant centering member for centering body 30 on the inner circumference of unit 3. The longest section 46 bounds almost over its full length the dimensionally rigid hollow chamber 41. Section 46, like sections 34, 35, forms by its outer circumference a bound member 42 of an outlet duct 55 which is always subjected to the same fluid pressure as chamber 21. Duct 55 begins at the end edge of lip 17 between this and body 30 and continues annularly and/or as a length groove up to the end wall of unit 3. The upstream end of body 30, 31 forms a stop 43 for pretensioned support of sections 31 to 33 on body 9 with edge 37. Resilient section 31 may be centered by its helical outer circumference at the inner circumference of shell 23. Section 46 forms by its outer circumference a dimensionally rigid centering member 44 for movably guiding on inner circumferences of unit 3. Section 33 may be radially spaced from the opposing walls.

The downstream end of body 30, 46 forms as part of an outlet valve 48, a dimensionally rigid valve element 45 having a protuberance of reduced diameter. The dimensionally rigid closing faces of valve 48 may be formed by end and/or circumferential faces. When closed, the end face 38 of member 44, 45 adjoins the inside of end wall 49 which is traversed in one part by a stepped nozzle duct. The outer end of this nozzle duct has a diameter of less than one millimeter or half a millimeter and forms outlet 20 along a axis 10 the atomizer nozzle. The closing faces may bound swirler means for generating a rotational flow about axis 10 and may for this be provided with suitable depressions. Member 32 belongs to inlet valve 47 of pump 6. The valve seat of valve 47 is formed by an inner or annular shoulder of shell 23. Thus, the same pressure also substantially exists from valve 47 to valve 48 since, in between, all medium spaces are permanently interconnected.

Wall 49 belongs, like parts 17 to 19, to a one-part traveling member 50. The runner shell 51 directly adjoins wall 49 only in direction 86 and forms lip 17. Piston 18 protrudes over the outer runner circumference in direction 85 and is spaced from lip 17. Piston 18 is shorter than its diameter, and is always located within wall 14. Shell 51 has a shoulder 52 which is spaced in the direction 85 from cup piston 18, located at the outer circumference, annularly protruding and pointing in direction 85. A corresponding shoulder 53 is provided in the same length portion and on the inner circumference of shell 51. Face 53 points in direction 86. A sleeve or valve body 54 protrudes in direction 86 from the inside of wall 49 and is radially spaced from while being located within shell 51. Member 44, 45 is guided and radially centered within element 54. Thereby, it is provided that in the abutting position the free end of body 54 abuts on that shoulder of body 40 which envelopes members 44, 45. Between the slidingly interengaged circumferential faces of members 45, 54 and with valve 48 open, the medium is able to flow through, for example, through length or swirl grooves. In the rest position face 38 sealingly closes the inner end of the nozzle duct.

The inner circumference of shell 51 bounds duct 55 opposite to body 30. Section 46 may have one or more circumferentially distributed flats 56 at the outer circumference and connecting upstream to shoulder 53 up to member 35. At flats 56 duct 55 then includes flared duct cross-sections to mollify the flow. The inner circumference of continuous shell 19, 51 forms a counter member 51, which is juxtaposed downstream directly with lip 17. Member 57 fixedly receives fastener 34 inserted into member 57 in direction 85.

Member 18 simultaneously forms a movable valve body of a valve 56 for a second fluid, particularly air for venting reservoir 29 through body 4. Thereby, air does not gain access to the medium spaces of pump 6. The inner circumference of wall 14 forms an annular shoulder or control edge 59 of a stationary valve body 76. In the rest position the sealing lip of member 18 is in pressure tight contact with member 46. After a first partial stroke sealing lip 18 jumps over edge 59 so that the sealing contact is cancelled and air is able to flow in direction 86 through shell 14 when space 29 is evacuated.

Unit 3 has in axis 10 a one-part runner body 60. Body 60 forms at its upstream end one or more locking members 61 jutting radially inwardly, an actuating member 62, such as a handle. Downstream thereof body 60 has a centering member 63 centering relative to traveling member 50, a protection member 64 for traveling member 50, a stop 66 for axial support on traveling member 50, a support member 63 for piston 18, an end wall 68 tapered in direction 85 as a truncated cone and a stop member 65 as the upstream outermost face for abutting on wall 12. Body 60 is mounted on traveling member 50 in direction 86 until its stop 66 located within wall 68 firmly comes into contact with shoulder 52. Downstream thereof, the outer circumference of shell 51 and the inner circumference of wall 68 are in contact with each other in a tight press fit. Upstream thereof, the shell shaped duct and centering member 63 freely protrudes from wall 68 in direction 86. Thus the free end of member 63 is a support member 67 located directly adjacent to the bottom wall of piston 18 and protecting piston 18 from excessive deformation. Also shell 64 projects only in direction 86 over wall 68 while being radially spaced from shell 63. At its end shell 64 translates into members 61, 62, 65 which jut over the inner and/or outer circumference of shell 64. The end wall forming members 62, 65 may be circular or oblong in axial view. Thus the smallest width of this finger shield corresponds to the outer width of shell 64. Shell 51 traverses and juts in direction 85 beyond body 60 as a slim stud which may be introduced into a body or nasal opening. on completion of being introduced wall 68 abuts against the bound of the patients opening which it may flare or sealingly close.

Valve 58 belongs to a second fluid guide separate from the medium guide, namely a vent 70. The vent chamber 71 adjoins the valve 58 downstream in direction 86 and is annularly bounded by walls 14, 19 while being sealingly closed by valve 58 with respect to the associated fluid supply, in this case the environmental atmosphere. The other end of chamber 71 adjoins an axial duct 72 traversing the wall 12. Duct 72 is located between walls 13, 14. Duct 72 translates radially outwards into a significantly narrower, angular duct 73. Duct 73 is bounded by the bottom and inner circumference of space 15 and by the outer end face and the outer circumference of flange 22. Thus duct 73 has a radial and a shorter axial duct leg porting by one end directly between the concentrical support faces of the two bodies 8, 9. This port is covered by a germ filter 74 or annular disk. The cited support faces rest on filter 74 which sealingly rests on the outer circumference of shell 23 with radial compressure. Filter 74 is located between walls 12, 22 and an annular disk or elastomeric seal 75. Seal 75 directly sealingly supports on filter 74. Thus air flows from the port of duct 73 into filter 74, therewith in radially against axis 10 and then between the outer circumference of shell 23 and the inner circumference of seal 75 into the interior of reservoir 29.

Wall 14 juts permanently in direction 85 between walls 63, 64. Wall 14 has at the outer circumference a locking or centering member 77 for positively abutting locking member 61 in the rest position. Thus unit 3 is prevented from being withdrawn from unit 2. The outer circumference of wall 14 forms an outer guide 78 on which during the operating stroke body 60 is slidingly guided with members 61 independent from body 50.

Figure 2:
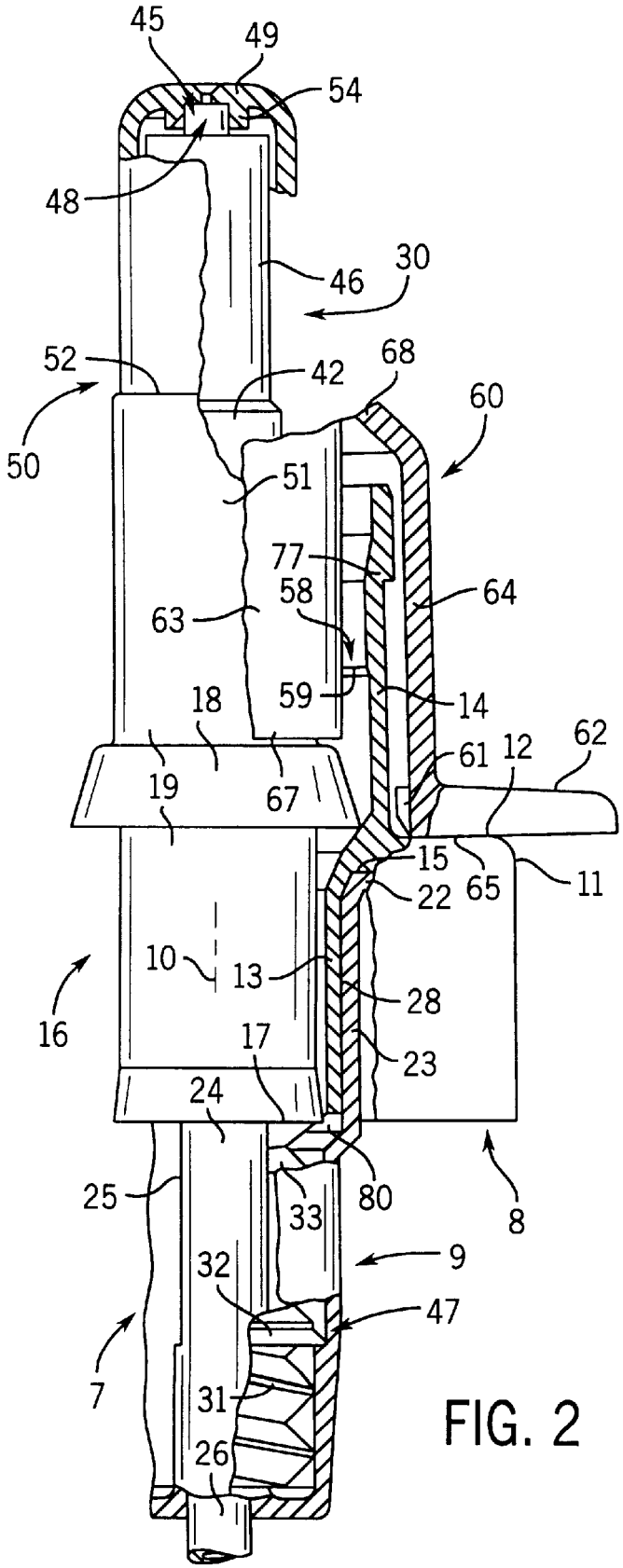
FIG. 2 is a detail of the dispenser of FIG. 1 in the actuated end position.

Piston 17 is permanently guided only by shell 13. In the actuated end position radial pressure relief means are effective for plunger lip 17 like for lip 18. Lip 17, therefore, runs into an abruptly flared annular space 80 over the end edge 81 of wall 13. Space 80 is bounded at the outer circumference and on one end side by shell 23 and at the other end side by edge face 81. As in FIG. 2 the sealing edge of lip 17 overlaps edge 81 just short before reaching the end position so that it is then located within space 80 free of any contact and without axial abutting. In the end position end face 65 of the finger shield abuts around wall 14 on the outside of wall 12. Face 65 is remote from handle 62. Thus, in this position cap 11 may be axially pressed onto the neck of reservoir 29 until being firmly connected although thereby the pressing force is fed into face 62.

Body 9 bounds between parts 23, 24 a reception space 82 accommodating springs 31, 33 and dimensionally rigid valve body 32. Space 80 is then bounded by shell 13 in an axially adjoined zone. The shell of cap 11 comprises on the inner circumference a projecting locking member 84 for positively engaging a complementary counter member of the outer circumference of the reservoir neck. Member 84 may be caused to engage the counter member simply by axial motion. Thereby, the cap shell is primarily and resiliently flared before then springing back when in the axial end position. Member 84 is a snap member, but could also be a female thread, a metalic crimp ring or the like. The upstream end wall of cup body 9 has at its inside radial stop projections 83, such as ribs, distributed about the projection 24. Stop 43 supports against elements 83 between which the medium flows from chamber 36 into the antechamber.

Except for plunger lips 17, 18 and members 31, 33, 35 all other components of the dispenser 1 are dimensionally stable in operation. The dimensional relationships as depicted are particularly favorable. The length of the dispenser 1 between the upstream end of housing 7 and wall 49 in FIG. 1 is less than 15 cm, 10 cm or 8 cm. While discharging medium the dispenser 1 is held so that one finger supports on the bottom of reservoir 29 and two fingers rest on the actuating member 62 on both sides of shell 64.

By compressing member 62 in direction 86 chambers 21, 36 are volumetrically reduced so that after a first partial stroke valve 47 closes counter spring 31 as a function of the travel motion path. Also, thereafter medium continues to be further pumped from chamber 36 back into reservoir 29. Pin 24 emerges over a partial length into space 41 and displaces medium therefrom. In chamber 21 a fluid pressure is built up effective up to face 38 until this pressure causes section 44 to 46 to be shifted as a control plunger in direction 86 and counter spring 35. Thereby, projection 44, 45 may always remain in valve body 48 or emerge out therefrom. In the latter case also the circumferential faces of valve bodies 45, 48 may sealingly interact in the closed state.

As soon as valve 48 has opened the medium flows from chamber 21 through outlet duct 55 into the nozzle duct and out of outlet 20. Due to the single or double helical guiding faces 39, 40 the medium is caused to swirl in the associated chambers. The helical pitch is for this purpose steep, particularly steeper than 300, 450 or 600. Thus, upon length changes also a torsional stress is built up and depleted in the springs. This torsion is superimposed on the axial spring action.

On release of handle 62 the dispenser 1 is reversed to its rest position by spring 33 and valve 48 closes immediately whilst chambers 21, 36 are flared and valve 47 opened. Thus, medium is permitted to flow from reservoir 29 directly into chamber 36 and therefrom via edge 37 and valve 47 into chamber 21. Thus, all chamber or medium spaces are always entirely filled with medium.

The cited features, such as properties, effects, configurations etc. may be provided precisely as described, or merely substantially or approximately so and may also greatly deviate therefrom depending on the particular requirements.

Pin 24 reaches permanently up to section 46 so that chamber 36 is always annular from spring 31 up over the full length of spring 35. Bodies 8, 9 on the one hand, and bodies 50, 60 on the other, may also be in one part with each other. A few up to all components of the dispenser 1 are made of polyethylene so that gamma ray sterilization of the dispenser 1 is possible. Parts 50, 30 may be preassembled so that already thereafter the closing force of the valve 48 is preset.

What is claimed is:

1. A dispenser for discharging media, comprising:

a base body (4);

a dispensing end wall (49);

a duct (55) penetrating said dispensing end wall (49) to provide a duct outlet;

a medium outlet (20) in communication with said duct outlet, and an actuating unit (5) including a traveling member (50), said traveling member (50) traveling relative to said base body (4) and being an integral member and including at least two of a medium impeller portion (17), a base body closure portion (18) for the base body (4), closing tightly an atmospheric entrance through the dispenser, a valve body portion (54), and a base body blocking portion (52) for blocking withdrawal of the traveling member (50) from the base body (4), and wherein said at least two portions (17, 18, 54, 52) of traveling member (50) together with said dispensing wall (49) provide an integral member.

2. The dispenser according to claim 1, wherein said base body closure portion (18) includes a closure lip located downstream of said medium impeller portion (17).

3. The dispenser according to claim 1 wherein said traveling member (50) further includes an individual circumferential face, and wherein said base body closure portion (18) and said medium impeller portion (17) protrude beyond said individual circumferential face of said traveling member (50).

4. The dispenser according to claim 1, wherein said base body closure (18) is radially offset with respect to said medium impeller (17) including a piston lip, said base body closure portion (18) closing said base body (4) and said medium impeller portion (17) pressing the medium out of said base body (4) upon being actuated.

5. The dispenser according to claim 1 and further including a preassembled module, wherein said base body blocking portion (52) of said runner (50) is included in said preassembled module, said base body blocking member (52) preventing withdrawal of said traveling member (50) from said base body (4), said runner (50) being displaced with respect to said base body (4) when said actuating unit is actuated.

6. The dispenser according to claim 1, and further including a catch member (61), wherein said catch member (61), is radially offset with respect to at least one of said portions (17, 18, 52, 54) of said traveler member (50).

7. The dispenser according to claim 1 and further including a catch member (61) and an outer circumference of said base body (4), wherein said catch member (61), includes an extension engaging said base body (4) at said outer circumference.

8. The dispenser according to claim 1 and further including a core body (30), wherein said core body (30) is inserted in said traveling member (50) at least one of partly rigidly fixed to said traveling member (50), and partly displaceable with respect to said traveling member (50).

9. The dispenser according to claim 8, wherein said core body (30) includes a valve element (45) displaceable with respect to said runner (50).

10. The dispenser according to claim 1 and further including a fluid valve (48), said fluid valve (48) substantially directly connecting to-said dispensing wall (49).

11. The dispenser according to claim 1, and further including a runner body (60) defining an abutting direction (86) and a component separate from said runner (50), wherein said runner body (60) substantially fixedly connects to said traveling member (50) with respect to said actuating direction (86), said runner body (60) including at least one of a catch member (61) connected to said base body locking member (52), an actuating member (62) located upstream of said medium outlet (20), a centering member (69) connecting to said traveling member (50), a protection member (64) shielding said traveling member (50), a passage member (63) protrudingly mounting said traveling member (50), a stop member (65) abutting said traveling member (50) on said base body (4), a stop element (66) abutting on said traveling member (50), and an axial abutment member (67) abutting a resilient element (18).

12. The dispenser according to claim 1 and further including a core body (30) inserted inside said base body (4), wherein said core body (30) includes at least one of a valve spring (31) of an inlet valve (47), a valve element of said inlet valve (47), a return spring (33) for reversing said medium impeller portion (17), a fastening member (34) fixedly engaging said traveling member (50), a valve spring (35) of an outlet valve (48), a suction chamber (36) for aspirating the medium, a transition edge (37) for deflecting the medium toward said medium impeller portion (17), a stop (43) removably supporting on said base body (4), a volumetrically variable pressure chamber (36) for repulsing the medium into a reservoir (29), an outer circumference with a helical guide face (39) for the medium, an inner circumference with a helical guide face (40) for the medium, a bellows (31, 33, 35), a resilient centering member (35) movably centering on said traveling member (50), a dimensionally rigid hollow chamber (41) for the medium, a bound member (42) for said duct (55) including an outlet duct, a stop (38) removably resting on said runner (50), a dimensionally rigid centering member (44) movably centering on said traveling member (50), and a valve element (45) of said outlet valve (48).

13. The dispenser according to claim 1 and further including first and second stops (12, 65) separate from said medium impeller portion (17) and included with said base body (4) and said runner (50), wherein in an actuated end position of said dispenser said first and second stops (12, 65) mutually abut.

14. The dispenser according to claim 1 and further including a vent duct (72, 73) and a reservoir chamber (29) for storing the medium, wherein said vent duct is angular and includes a first duct leg and a second duct leg angularly directly connecting to said first duct leg, separate and opposed end faces being included and bound said vent duct (73).

15. The dispenser according to claim 1 and further including a filter (74) and a vent duct (73) issuing into said filter (74), wherein said vent duct (73) is angular and includes angularly interconnected first and second duct legs, said second duct leg including a free end remote from said first duct leg, a butt joint being included and directly connecting said free end to said filter (74).

16. A dispenser for discharging media, comprising:

a base body (4);

a dispensing end wall (49);

a duct (55) penetrating said dispensing end wall (49) to provide a duct outlet;

a medium outlet (20) in communication with said duct outlet, and an actuating unit (5) including a traveling member (50), said traveling member (50) being an integral member and including at least two of a medium impeller portion (17), a base body closure portion (18) for the base body (4), a valve body portion (54), and a base body blocking portion (52) for blocking withdrawal of the traveling member (50) from the base body (4), and wherein said at least two portions (17, 18, 54, 52) of traveling member (50) together with said dispensing wall (49) provide an integral member;

further including a traveling member body (60) defining an abutting direction (86) and a component separate from said runner (50), wherein said traveling member body (60) substantially fixedly connects to said traveling member (50) with respect to said actuating direction (86), said traveling member body (60) including at least one of a catch member (61) connected to said base body locking member (52), an actuating member (62) located upstream of said medium outlet (20), a centering member (69) connecting to said traveling member (50), a protection member (64) shielding said traveling member (50), a passage member (63) protrudingly mounting said traveling member (50), a stop member (65) abutting said traveling member (50) on said base body (4), a stop element (66) abutting on said traveling member (50), and an axial abutment member (67) abutting a resilient element (18); and wherein said traveling member body (60) includes at least one of a cup, and an annular disc.

17. A dispenser for discharging media, comprising:

a base body (4);

a dispensing end wall (49);

a duct (55) penetrating said dispensing end wall (49) to provide a duct outlet;

a medium outlet (20) in communication with said duct outlet, and an actuating unit (5) including a traveling member (50), said traveling member (50) being an integral member and including at least two of a medium impeller portion (17), a base body closure portion (18) for the base body (4), a valve body portion (54), and a base body blocking portion (52) for blocking withdrawal of the traveling member (50) from the base body (4), and wherein said at least two portions (17, 18, 54, 52) of traveling member (50) together with said dispensing wall (49) provide an integral member;

further including a traveling member body (60) defining an abutting direction (86) and a component separate from said runner (50), wherein said traveling member body (60) substantially fixedly connects to said traveling member (50) with respect to said actuating direction (86), said traveling member body (60) including at least one of a catch member (61) connected to said base body locking member (52), an actuating member (62) located upstream of said medium outlet (20), a centering member (69) connecting to said traveling member (50), a protection member (64) shielding said traveling member (50), a passage member (63) protrudingly mounting said traveling member (50), a stop member (65) abutting said traveling member (50) on said base body (4), a stop element (66) abutting on said traveling member (50), and an axial abutment member (67) abutting a resilient element (18); and wherein said traveling member (60) includes at least one end wall (68) defining an end face and a remote face remote from said end face, projections (63, 64) being included and projecting from said end face, said remote face being substantially without projections.

18. A dispenser for discharging media, comprising:

a base body (4);

a dispensing end wall (49);

a duct (55) penetrating said dispensing end wall (49) to provide a duct outlet;

a medium outlet (20) in communication with said duct outlet, and an actuating unit (5) including a traveling member (50), said traveling member (50) being an integral member and including at least two of a medium impeller portion (17), a base body closure portion (18) for the base body (4), a valve body portion (54), and a base body blocking portion (52) for blocking withdrawal of the traveling member (50) from the base body (4), and wherein said at least two portions (17, 18, 54, 52) of traveling member (50) together with said dispensing wall (49) provide an integral member;

and further including a support body (8) and a pressure body (9) substantially rigidly connected to said support body (8) with respect to at least one direction (85, 86), wherein said base body (4) includes said support body (8) including a fastener (84) for directly fastening said support body (8) on a base support (8).

19. The dispenser according to claim 18, wherein said support body (8) includes at least one of a support flange (12) for axially supporting on the base support (29), an inner circumference including a locking member (84) for engaging the base support (29), a support member supporting a seal (75), a duct bound of a flow duct (73), a running wall (13 displaceably receiving said impeller (17), a relief member (79) radially stress-reliefing said impeller (17) when displaced, a slide wall (14) engaging said base body closure (18), a valve element (76), a locking member (77) locking said traveling member (50), a shield (14) shielding said traveling member (50), an outer guide externally guiding said traveling member (50), an extension (14) extending inside said actuating unit (5), a centering member (15) annularly centering said pressure body (9), and a secondary duct (72) for a secondary fluid.

20. The dispenser according to claim 18, wherein said pressure body (9) includes at least one of a connector flange (22), a pressure chamber (21) bounded by said medium impeller portion (17), an appendage protruding upstream out of said support body (8), a projection (24) jutting into said traveling member (50), an inlet duct passing the medium toward said medium outlet (20), a riser tube (26) for the medium, an annular valve seat (47), a spring mount, a spring stop (83), a support face (27) supporting an axial seal (75), and a tensioning face (28) radially clamping and sealing said support body (8).

21. A dispenser for discharging media, comprising:

a base body (4);

a dispensing end wall (49);

a duct (55) penetrating said dispensing end wall (49) to provide a duct outlet;

a medium outlet (20) in communication with said duct outlet, and an actuating unit (5) including a traveling member (50), said traveling member (50) being an integral member and including at least two of a medium impeller portion (17), a base body closure portion (18) for the base body (4), a valve body portion (54), and a base body blocking portion (52) for blocking withdrawal of the traveling member (50) from the base body (4), and wherein said at least two portions (17, 18, 54, 52) of traveling member (50) together with said dispensing wall (49) provide an integral member;

and further including a core body (30) inserted inside said base body (4), wherein said core body (30) includes at least one of a valve spring (31) of an inlet valve (47), a valve element of said inlet valve (47), a return spring (33) for reversing said medium impeller portion (17), a fastening member (34) fixedly engaging said traveling member (50), a valve spring (35) of an outlet valve (48), a suction chamber (36) for aspirating the medium, a transition edge (37) for deflecting the medium toward the medium impeller portion (17), a stop (43) removably supporting on said base body (4), a volumetrically variable pressure chamber (36) for repulsing the medium into the reservoir (29), an outer circumference with a helical guide face (39) for the medium, inner circumference with a helical guide face (40) for the medium, a bellows (31, 33, 35), a resilient centering member (35) movably centering on said traveling member (50), a dimensionally rigid hollow chamber (41) for the medium, a bound member (42) for said duct (55) including an outlet duct, a stop (38) removably resting on said traveling member (50), a dimensionally rigid centering member (44) movably centering on said traveling member (50), and a valve element (45) of said outlet valve (48), wherein said core body (30) is made in one part.

22. A dispenser for discharging media, comprising:

a base body (4);

a dispensing end wall (49);

a duct (55) penetrating said dispensing end wall (49) to provide a duct outlet;

a medium outlet (20) in communication with said duct outlet, and an actuating unit (5) including a traveling member (50), said traveling member (50) being an integral member and including at least two of a medium impeller portion (17), a base body closure portion (18) for the base body (4), a valve body portion (54), and a base body blocking portion (52) for blocking withdrawal of the traveling member (50) from the base body (4), and wherein said at least two portions (17, 18, 54, 52) of traveling member (50) together with said dispensing wall (49) provide an integral member;

and further defining an operating position, wherein said medium impeller portion (17) includes a piston lip sealingly sliding on a counterface of said base body (4), said piston lip including a free end face which is free of abutting contact when in said operating position including an actuated end position, when actuated and displaced, said free end face including a leading edge.

23. A dispenser for discharging media, comprising:

a base body (4);

a dispensing end wall (49);

a duct (55) penetrating said dispensing end wall (49) to provide a duct outlet;

a medium outlet (20) in communication with said duct outlet, and an actuating unit (5) including a traveling member (50), said traveling member (50) being an integral member and including at least two of a medium impeller portion (17), a base body closure portion (18) for the base body (4), a valve body portion (54), and a base body blocking portion (52) for blocking withdrawal of the traveling member (50) from the base body (4), and wherein said at least two portions (17, 18, 54, 52) of traveling member (50) together with said dispensing wall (49) provide an integral member;

and further defining an operating position, wherein said medium impeller portion (17) includes a piston lip sealingly sliding on a counterface of said base body (4), said counterface including a relief depression (80) receiving said piston lip when in said operating position, thereby stress relieving said piston lip, said relief depression (80) being bounded by separate body elements (8,9) of said base body (4).

24. The dispenser according to claim 23, wherein said body elements (8, 9) include a first body element (8) including a first wall (13), said body elements (8, 9) including a second body element (9) including a second wall (23) engaging said first wall (13), said first and second walls (13, 23) commonly bounding said relief depression (80).

25. A dispenser for discharging media, comprising:

a base body (4);

a dispensing end wall (49);

a duct (55) penetrating said dispensing end wall (49) to provide a duct outlet;

a medium outlet (20) in communication with said duct outlet, and an actuating unit (5) including a traveling member (50), said traveling member (50) being an integral member and including at least two of a medium impeller portion (17), a base body closure portion (18) for the base body (4), a valve body portion (54), and a base body blocking portion (52) for blocking withdrawal of the traveling member (50) from the base body (4), and wherein said at least two portions (17, 18, 54, 52) of traveling member (50) together with said dispensing wall (49) provide an integral member;

and further including first and second stops (12, 65) separate from said medium impeller portion (17) and included within said base body (4) and said runner (50), wherein in said actuated end position of said dispenser said first and second stops (12, 65) mutually abut, and wherein at least one of said first and second stops (12, 65) is freely accessible from outside the dispenser (1), said actuating unit (5) including an actuating member (60) separate from said dispensing wall (49) and including an upstream end, said upstream end including said second stop (65).

* * * * *